United States Patent [19]

Mejia et al.

[11] 4,359,646

[45] Nov. 16, 1982

[54] INTRUSION DETECTING SWITCH

[75] Inventors: Ezequiel Mejia, Longuevil; Peter S. Minaki, La Prairie; Walter D. Weind, Westmount, all of Canada

[73] Assignee: Honeywell Inc., Minneapolis, Minn.

[21] Appl. No.: 225,239

[22] Filed: Jan. 15, 1981

[30] Foreign Application Priority Data

Jan. 22, 1980 [CA] Canada ..... 344131

[51] Int. Cl.[3] ..... G08B 13/08; G08B 13/24

[52] U.S. Cl. ..... 307/116; 116/85; 248/551; 340/547; 340/693

[58] Field of Search ..... 340/547, 693; 307/116; 338/32 H; 248/551; 347/693; 116/85

[56] References Cited

U.S. PATENT DOCUMENTS

| | | | |
|---|---|---|---|
| 1,844,557 | 2/1932 | Bobrick | 248/551 X |
| 3,470,554 | 9/1969 | Corbell | 340/547 X |
| 3,516,036 | 6/1970 | Lea | 116/85 X |
| 4,190,221 | 2/1980 | Updike | 248/551 |
| 4,241,337 | 12/1980 | Prada | 340/547 |
| 4,292,629 | 9/1981 | Kerr et al. | 340/547 |

*Primary Examiner*—Daniel M. Yasich

*Attorney, Agent, or Firm*—Trevor B. Joike

[57] ABSTRACT

An intrusion detecting switch is disclosed having an operator and a sensing device for sensing the detection of intrusions and to a protected area. The operator may be a magnet and the sensing device may be Hall effect switches the resistance of which will switch between high and low values in the presence and absence of the magnetic field. A mounting device may be provided for mounting the housing containing either the sensing device or the operator to its support. The mounting device is located behind the operator or sensing device such that if the housing is to be removed from its support, the sensing device or operator must be first removed which will result in an alarm.

17 Claims, 2 Drawing Figures

INTRUSION DETECTING SWITCH

BACKGROUND OF THE INVENTION

This invention relates to the detection of an opening or closing of a closure member of an enclosure by an intruder and, more specifically, to a means for mounting the detector to the enclosure and for using Hall effect switching devices as the sensing element to detect the opening and closing.

Detecting unauthorized entrance into safes, bank vaults or protected enclosures has been a problem for many years. There are in existence today many types of devices for sensing attempts to intrude into these protected enclosures. For example, seismic detectors are included for sensing vibrations which may be caused by cutting or drilling tools, heat sensing devices may likewise be included for sensing heat generated from cutting torches or the like, and various switch mechanisms are utilized for sensing unauthorized openings.

Heretofore, such switches have been mechanical devices such as magnetically operated reed switches wherein the reed switches are attached to the frame of a doorway leading to a protected enclosure and the magnetic operator is attached to the door of the protected area. If the door is opened, the loss of the magnetic field generated by the magnet will operate the reed switches to provide an alarm. One of the problems associated with the use of such mechanical switches is that noise is generated when the contacts strike each other allowing the skilled burglar to listen to the noise and to devise a way of generating an external magnetic field so that the reed switches will not be operated when he opens the door during non-business hours. Even those reed switches which use one reed switch operated by the magnet on the door and a second normally open reed switch which will close in the presence of an external field may be defeated in this manner.

The present invention is designed to provide a silent intrusion detecting switch which can be used to detect the opening or closing of the closure member of a protected area such as the door to a safe or vault, or the door or window of a room. Moreover, the intrusion detecting switch should be mounted in such a way as to make it extremely difficult to substitute the operator of the switch by removing it from the closure itself.

SUMMARY OF THE INVENTION

The present invention eliminates many of these problems by providing an intrusion detecting switch which is both silent in operation and mounted in such a way as to be substantially tamper proof. Specifically, the invention incorporates a stationary housing member attached to a wall of the enclosure to be protected and a movable housing member attached to a closure member, such as a door or window, of the enclosure. A Hall effect switching mechanism is incorporated in one of the housing members and a magnetic operator is incorporated into the other housing member so that as the two housing members are moved apart, the changing magnetic field established by the magnetic operator will cause the Hall effect switching mechanism to switch and thus provide an indication that the closure member is being opened or closed. Moreover, a mounting device, such as a screw, which attaches the housing member in which the operator is located to its support is assembled behind the operator with another mounting device such as a setscrew retaining the operator within the housing; thus, the only way to move the housing member containing the operator is to first remove the operator, and removal of the operator will cause the switching mechanism to trip and provide an alarm.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
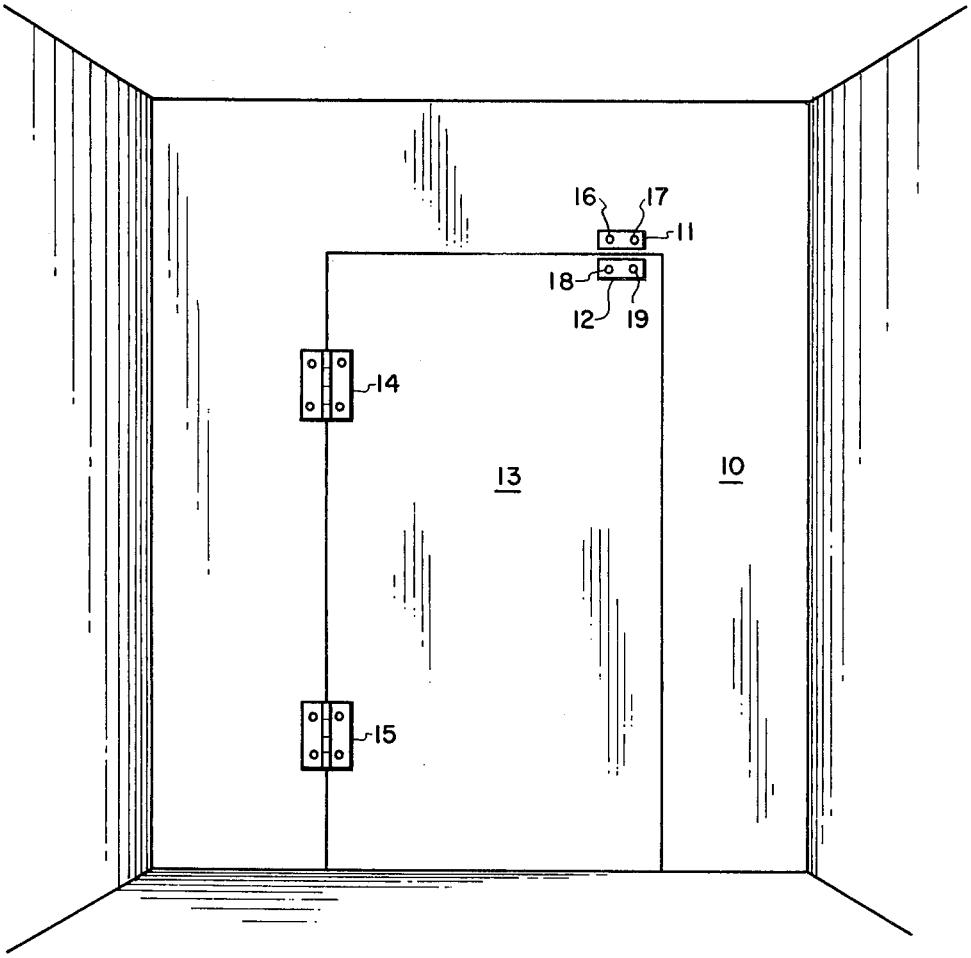
FIG. 1 is a diagram showing the way in which the intrusion detecting switch of the present invention may be mounted to protect a closure member of an enclosure; and, FIG. 2 shows the details of the intrusion detecting switch.

In FIG. 1, enclosure 10 may be a room, safe or bank vault. The intrusion detecting switch which is the subject of this invention can be mounted for sensing the opening and closing of either a door or window. In FIG. 1, the intrusion detecting switch is arranged to sense the opening of a door and is comprised of stationary housing member 11 mounted to inside wall 11 of enclosure 10 and movable housing member 12 mounted to door 13 supported by hinges 14 and 15. Door 13 may be controlled by a time lock, combination lock or other types of security means the controls for which are on the other side of the door. Housing members 11 and 12 may be mounted to their respective supports by use of respective screws 16, 17, 18 and 19.

Figure 2:
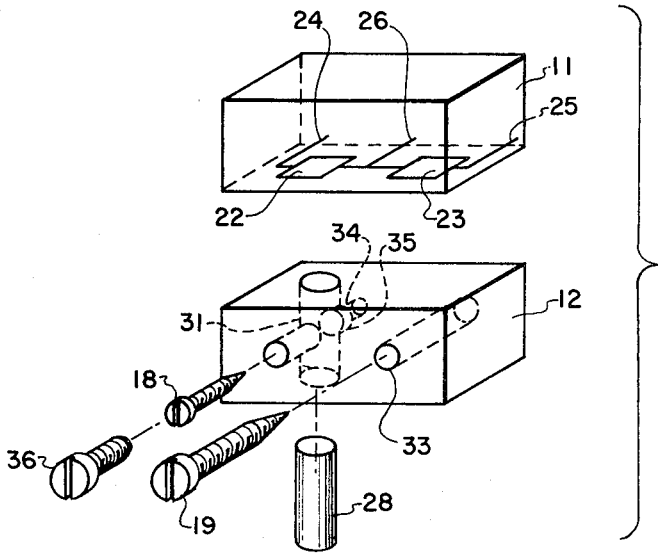

As shown in FIG. 2, stationary housing member 11 contains Hall effect switches 22 and 23 connected in series circuit between terminals 24 and 25 with a common terminal 26 connected to the common junction. As is well known, Hall effect devices switch their resistance between high and low values in the presence of magnetic fields. Thus, Hall effect switches 22 and 23 may be arranged so that when they are in the presence of the magnetic field generated by magnet 28 connected in housing member 12, Hall effect switch 22 will be switched to provide an output on terminal 24 but Hall effect switch 23 will not be switched so that no output is provided on terminal 25. Thus, Hall effect switch 23 acts as a tamper device such that if an alternate magnet is brought into proximity of housing member 11 in an attempt to hold devices 22 and 23 in the state they normally have in the presence of the field generated by magnet 28, Hall effect switch 23 will switch to provide a tamper output on terminal 25. Moreover, it is quite apparent that additional Hall effect switches may be included within stationary housing member 11 to increase the sensitivity and flexibility provided by the disclosed intrusion detecting switch. Furthermore, a switch can be mounted to the rear surface of housing member 11 to detect any attempt to remove housing member 11 from the wall of enclosure 10.

Movable housing member 12 has cylindrical channel 31 extending from the bottom of stationary housing member 12 partially therethrough. When movable housing member 12 is to be mounted to door 13 of enclosure 10, first mounting device or screw 18 is inserted through corresponding slot 34. Screw 18 is short so that, during insertion, it will pass entirely through channel 31. The head of screw 18 will then reside within seat 35 formed in channel 34 of housing member 12 to hold housing member 12 to door 13. When magnet 28 is inserted into channel 31, it will completely cover the head of screw 18. Second mounting device or setscrew 36 retains magnet 28 within housing 12. Housing member 12 may also have third mounting screw or device 19 inserted through corresponding slot 33 of movable housing member 12 and into door 13 for aiding in the mounting of housing member 12 to the door.

Thus, any attempt to remove housing member 12 from door 13 will require removal of magnet 28 first which takes away the magnetic field from switches 22 to provide an alarm output. Any attempt to substitute an alternate magnet for magnet 28 by positioning an alternate device along side of stationary housing member 11 mounted to the wall of enclosure 10 will cause tamper Hall effect switch 23 to operate.

Terminal 26 may be connected to a source of power and terminals 24 and 25 may be connected through switches or relays to the other side of the source. The switches or relays may then operate alarm devices. The wires 24, 25 and 26 may be run through the wall of vault 10. It is clear that housing member 12 may be the stationary housing member mounted to the wall and housing member 11 may be the movable housing member mounted to the door.

The embodiments of the invention in which an exclusive property or right is claimed is defined as follows:

1. An intrusion detecting apparatus for detecting intrusions into an enclosure comprising:

first housing means attached to a wall of the enclosure;

second housing means attached to a closure member of the enclosure and in proximity to said first housing means;

Hall effect sensing means contained in one of said housing means, said Hall effect sensing means being connected in a circuit for supplying power thereto and for providing an output therefrom;

magnetic means contained in the other of said housing means for controlling said output of said Hall effect sensing means dependent upon the relative proximity of said Hall effect sensing means to said magnetic means; and a mounting device for mounting said other of said housing means to said enclosure so that said magnetic means must be removed before said other of said housing means can be removed from said enclosure.

2. The apparatus of claim 1 wherein said Hall effect sensing means comprises a Hall effect switching means for providing a switched output dependent upon its proximity to a magnetic field, said magnetic means controllably switching said Hall effect switching means to a first condition when said Hall effect switching means is within the field established by said magnetic means and for controllably switching said Hall effect switching means to a second condition when said Hall effect switching means is not within said field.

3. The apparatus of claim 2 wherein said Hall effect switching means comprises first and second Hall effect switches contained in said one of said housing means, said first Hall effect switch arranged to provide an output having a first level and said second Hall effect switch being arranged to provide an output of a second level when said first and second housing means are within close proximity to each other.

4. The apparatus of claim 3 wherein said magnetic means comprises a magnet contained in the other of said housing means for providing said field.

5. The apparatus of claim 4 wherein said first and second switches are located in said first housing means and said magnet is located with said second housing means.

6. The apparatus of claim 5 wherein said mounting device is covered by said magnet for mounting said second housing means to said closure member.

7. The apparatus of claim 6 wherein said mounting device is a screw.

8. An intrusion detector for detecting intrusions into an enclosure comprising:

first housing means mounted to a wall of said enclosure, said wall acting as a support for said first housing means;

second housing means mounted to a closure member of said enclosure, said closure member acting as a support for said second housing means;

sensing intrusion means contained in one of said housing means;

operator intrusion means contained in the other of said housing means for operating said sensing means during intrusions; and, mounting means for mounting said one of said housing means to its support and including a first mounting device covered by one of said intrusion means and a second mounting device for holding said one of said intrusion means within its housing means so that access to said first mounting device can only be obtained by first removing said one of said intrusion means.

9. The detector of claim 8 wherein said sensing intrusion means is located within said first housing means and said operator intrusion means is located within said second housing means.

10. The detector of claim 9 wherein said first mounting device is located behind said operator intrusion means for mounting said second housing means to its support.

11. The detector of claim 8 wherein said operator intrusion means comprises a magnet.

12. The detector of claim 11 wherein said first mounting device comprises a screw for securing said one of said housing means to its support.

13. The detector of claim 12 wherein said second mounting device comprises a second screw for retaining said one of said intrusion means within its housing means.

14. The detector of claim 13 wherein said sensing intrusion means comprises Hall effect switching means for switching in response to an applied magnetic field which is supplied by said magnet.

15. The detector of claim 14 wherein said Hall effect switching means comprises first and second Hall effect switches one of which is controlled by said magnet and the other of which is controlled by an external magnetic field.

16. The detector of claim 15 wherein said first and second Hall effect switches are located within said first housing means and said magnet is located within said second housing means.

17. The detector of claim 16 wherein said first mounting device is located behind said magnet for mounting said second housing means to said closure member.

* * * * *